US008516936B2

(12) United States Patent
Nakajima et al.

(10) Patent No.: US 8,516,936 B2
(45) Date of Patent: Aug. 27, 2013

(54) SLITTER

(75) Inventors: Toshiaki Nakajima, Kyoto (JP); Hirokazu Kano, Kyoto (JP); Hiroyuki Yamamoto, Kyoto (JP); Kazunari Isozaki, Tochigi (JP)

(73) Assignees: Nishimura Mfg. Co., Ltd, Kyoto (JP); Hiyama Industry Co., Ltd., Ibaraki (JP)

( * ) Notice: Subject to any disclaimer, the term of this patent is extended or adjusted under 35 U.S.C. 154(b) by 505 days.

(21) Appl. No.: 12/672,138

(22) PCT Filed: Apr. 15, 2009

(86) PCT No.: PCT/JP2009/057591

§ 371 (c)(1),
(2), (4) Date: Feb. 4, 2010

(87) PCT Pub. No.: WO2010/119527

PCT Pub. Date: Oct. 21, 2010

(65) Prior Publication Data

US 2012/0024123 A1 Feb. 2, 2012

(51) Int. Cl.
*B26D 7/18* (2006.01)

(52) U.S. Cl.
USPC ..... 83/102; 83/436.75; 83/508.3

(58) Field of Classification Search
USPC 83/102, 666, 670, 436.3–436.7, 508.2–508.3, 83/436.75, 495, 107
See application file for complete search history.

(56) References Cited

U.S. PATENT DOCUMENTS

| | | | | |
|---|---|---|---|---|
| 3,429,959 | A * | 2/1969 | Salhofer | 264/175 |
| 3,664,115 | A * | 5/1972 | Watson | 57/31 |
| 3,760,697 | A * | 9/1973 | Besemann | 493/33 |
| 4,063,692 | A * | 12/1977 | Buggy | 242/530.3 |
| 4,109,842 | A * | 8/1978 | Aquilla | 225/98 |
| 4,855,553 | A * | 8/1989 | Minobe | 264/489 |
| 4,951,891 | A * | 8/1990 | Kozbur et al. | 242/525.5 |
| 5,367,934 | A * | 11/1994 | MacNiel | 83/425.2 |
| 5,691,587 | A * | 11/1997 | Lamb | 310/103 |
| 5,727,724 | A * | 3/1998 | Dowling | 226/181 |
| 5,804,020 | A * | 9/1998 | Akao et al. | 156/251 |
| 5,899,129 | A * | 5/1999 | Sumida et al. | 83/76.9 |
| 5,946,996 | A * | 9/1999 | Oussani et al. | 83/444 |
| 6,094,795 | A * | 8/2000 | Davenport | 29/407.1 |
| 6,206,321 | B1 * | 3/2001 | Pumpe | 242/525.3 |
| 6,357,691 | B1 * | 3/2002 | Watanabe et al. | 242/545.1 |
| 6,841,735 | B1 * | 1/2005 | Schilson et al. | 174/117 F |
| 6,874,396 | B2 * | 4/2005 | Sanda | 83/102 |
| 7,188,414 | B2 * | 3/2007 | Schilson et al. | 29/868 |

(Continued)

FOREIGN PATENT DOCUMENTS

| | | |
|---|---|---|
| JP | 63-161247 | 10/1988 |
| JP | 06-227700 | 8/1994 |

(Continued)

*Primary Examiner* — Sean Michalski
(74) *Attorney, Agent, or Firm* — Kirchstein, et al.

(57) ABSTRACT

A slitter for slitting a web 1 wound by an oscillation winding method includes a guide roller 2. The guide roller 2 has an axial length shorter than width of the web 1. The slitter includes guide means guiding the web 1 to engage the web with the guide roller 2. The web 1 includes widthwise opposite end portions of the web 1 protruding out of axial opposite end portions of the guide roller 2. The slitter includes slit blades 6 slitting the web 1 at positions of the axial opposite end portions of the guide roller 2.

3 Claims, 7 Drawing Sheets

(56) References Cited

U.S. PATENT DOCUMENTS

| | | | | |
|---|---|---|---|---|
| 7,757,530 | B2 * | 7/2010 | Annoura | 72/186 |
| 2002/0079400 | A1 * | 6/2002 | Fujiwara et al. | 242/523.1 |
| 2003/0000360 | A1 * | 1/2003 | Sanda | 83/495 |
| 2003/0106402 | A1 * | 6/2003 | Solon | 83/19 |
| 2003/0150308 | A1 * | 8/2003 | Fujita et al. | 83/425 |
| 2009/0078814 | A1 * | 3/2009 | Prittie | 242/525 |
| 2012/0193057 | A1 * | 8/2012 | Ohyabu et al. | 162/283 |
| 2012/0240741 | A1 * | 9/2012 | Sanchez | 83/56 |

FOREIGN PATENT DOCUMENTS

| | | |
|---|---|---|
| JP | 07-257796 | 10/1995 |
| JP | 10-212059 | 8/1998 |
| JP | 2000-302305 | 10/2000 |
| JP | 2004-099190 | 4/2004 |

* cited by examiner

SLITTER

TECHNICAL FIELD

The present invention relates to a slitter for slitting a web such as a separator film used in an electronic component. In particular, the present invention relates to a slitter for slitting the web wound by an oscillation winding method.

BACKGROUND ART

In the case of a separator film, at first the film is manufactured by an extruder and then wound by a winder. An oscillation winding method is often used when winding. In the oscillation winding method, the separator film is traversed in the wide direction thereof while winding, as described in JP 10-212059 A (Patent document 1). Therefore, if the separator film has an uneven thickness in the wide direction thereof, the thick portions and the thin portions thereof are superposed alternately so that the film can be wound under even pressure and the winding roll can become a good shaped. Then a supply roll is put to a slitter, the separator film is supplied from the supply roll and slit into films having predetermined widths.

However, if the separator film is wound by the oscillation winding method just after being manufactured, the separator film includes widthwise opposite end portions which shrink significantly as time passes. It is believed that the reason relates to the material and winding conditions of the separator film. The separator film is made from synthetic resin such as porous polyolefin. If the separator film is wound by the oscillation winding method just after being manufactured, the widthwise center portion thereof is wound tightly, but the widthwise opposite end portions thereof are not wound tightly. Then the separator film is cooled with the state of the winding roll. Therefore, the widthwise opposite end portions shrink significantly.

Therefore, when the supply roll is put to a slitter and the separator film is supplied from the supply roll, the widthwise opposite end portions decrease in length by the shrinkage phenomenon to result in the difference in length between the widthwise opposite end portions and the widthwise center portion. Accordingly, when the separator film is engaged with a guide roller, only the widthwise opposite end portions thereof tense by the tension but the widthwise center portion thereof does not tense. In this connection, the separator film must be loosened. As a result, the device has a problem that the separator film gets wrinkles.

If not only the separator film but also another web is wound by the oscillation winding method, the widthwise opposite end portions thereof must shrink partly. Therefore, when the web is supplied from the supply roll and engaged with the guide roller, the device has similarly a problem that the web gets wrinkles.

It is, therefore, an object of the present invention to provide a slitter in which the web cannot get wrinkles when the web wound by the oscillation winding method is supplied from the supply roll and engaged with the guide roller.

Patent document 1: JP 10-212059 A

DISCLOSURE OF THE INVENTION

A slitter for slitting a web wound by an oscillation winding method includes a guide roller. The guide roller has an axial length shorter than width of the web. The slitter includes guide means guiding the web to engage the web with the guide roller. The web includes widthwise opposite end portions of the web protruding out of axial opposite end portions of the guide roller. The slitter includes slit blades slitting the web at positions of the axial opposite end portions of the guide roller.

According to a preferable embodiment, the guide means comprises an additional roller. The web is supplied from a supply roll and directed to the additional roller via the guide roller to be guided by the additional roller.

Further, the slitter includes an additional slit blade slitting the web into webs having predetermined widths. The web is directed to the additional slit blade via the additional roller.

Further, the guide roller includes a axial center portion formed by a body, and axial opposite end portions formed by a plurality of pieces. The pieces are separated from the body to adjust the length of the guide roller.

BEST MODE FOR CARRYING OUT THE INVENTION

Hereinafter, some embodiments of the present invention will be described.

Figure 1:
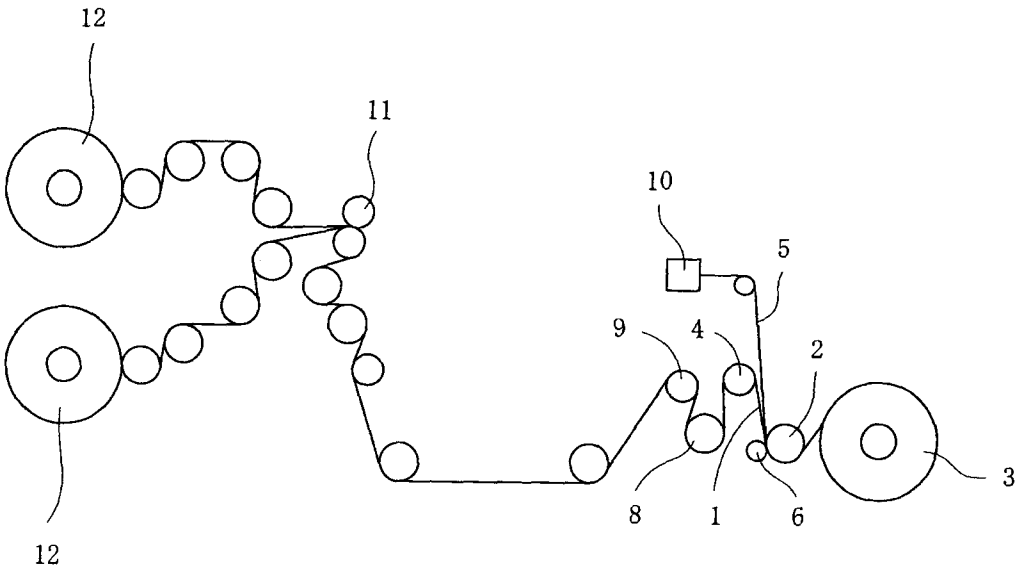
FIG. 1 is a side view illustrating an embodiment of the present invention.

FIG. 1 illustrates a slitter according to the invention. The slitter is used for slitting a web 1, including a guide roller 2. The web 1 comprises a separator film used in an electronic component, being wound on a supply roll 3. The web 1 is wound by an oscillation winding method.

Further, the web 1 is guided by guide means to be engaged with the guide roller 2. The guide means comprises an additional roller 4. The web 1 is supplied from the supply roll 3 and directed to the additional roller 4 via the guide roller 2. And then the web 1 is engaged with the additional roller 4. Therefore, the web 1 is guided by the additional roller 4 to be engaged with the guide roller 2. The web 1 is engaged with the guide roller 2 in a certain angular extent about the guide roller 2. Then the web 1 is directed to the additional roller 4 to be engaged with the additional roller 4 in a certain angular extent about the additional roller 4. Therefore, the flow direction of the web 1 is converted by the guide roller 2 and the additional roller 4. The guide roller 2 and the additional roller 4 rotate by friction when the web 1 is supplied.

Figure 2:
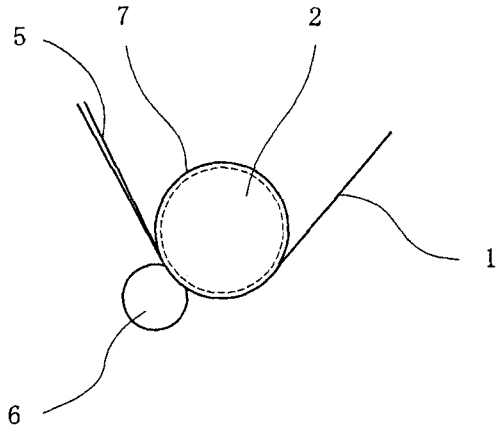
FIG. 2 is an enlarged view illustrating a slit blade and a guide roller in FIG. 1.
Figure 3:
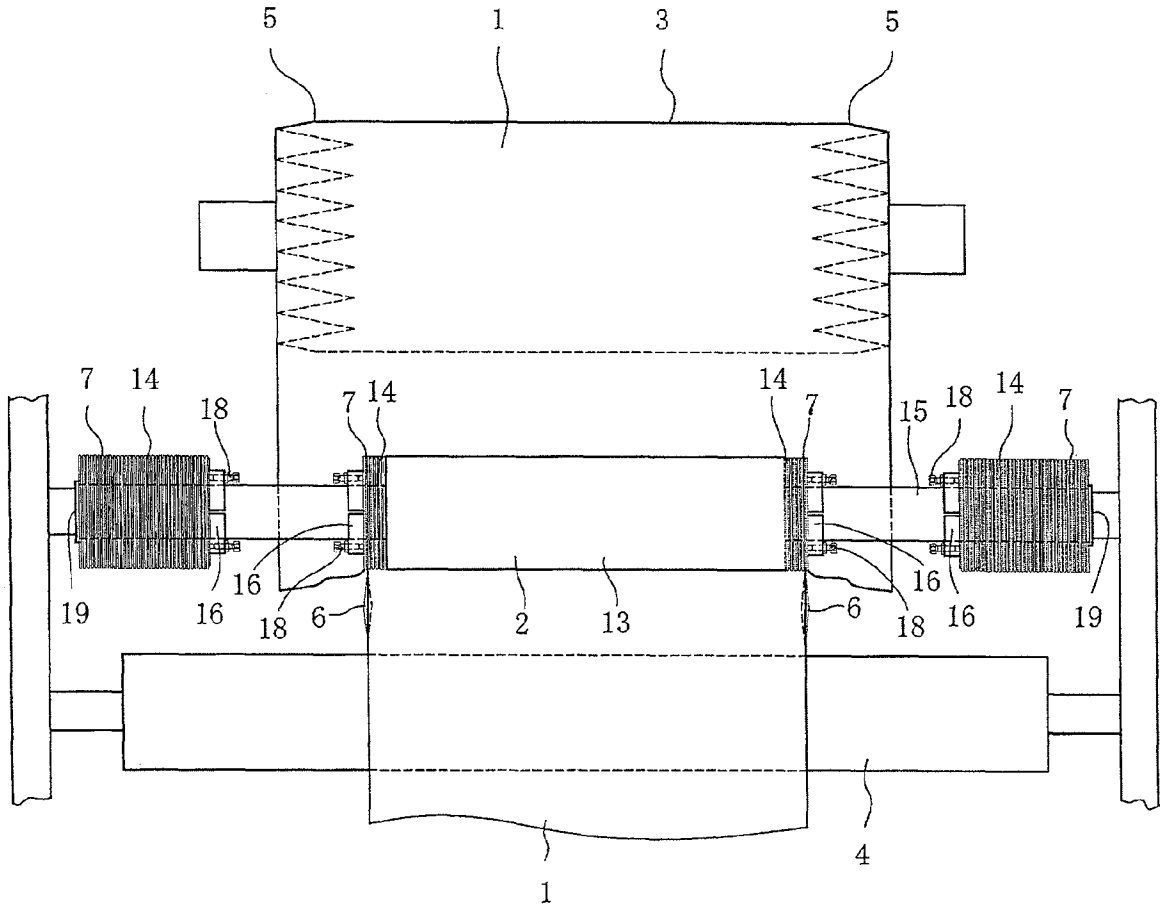
FIG. 3 is a plan view illustrating a supply roll and a guide roller in FIG. 1.

As shown in FIG. 3, the guide roller 2 has an axial length thereof shorter than the width of the web 1. The web 1 includes widthwise opposite end portions 5 protruding out of axial opposite end portions of the guide roller 2 when the web 1 is engaged with the guide roller 2. The web 1 is slit at positions of the axial opposite end portions of the guide roller 2 by a pair of slit blades. As shown in FIG. 2, in the embodiment, a circular blade 6 is used as the slit blade. A peripheral groove 7 is formed on the axial opposite end portions of the guide roller 2. The peripheral groove 7 is used as a lower blade, while the circular blade 6 is used as a upper blade. The web 1 is sandwiched between the upper blade and the lower blade to be slit. Therefore, the widthwise opposite end portions 5 is separated from the web 1. In the embodiment, the web 1 is engaged with the guide roller 2 in a certain angular extent about the guide roller 2 as described above and slit at the terminal end portion of the angular extent.

Then the web 1 is directed to additional rollers 8 and 9 via the additional roller 4, and the widthwise opposite end portions 5 are directed to a wider 10 to be wound. The additional rollers 4, 8 and 9 have a axial length thereof longer than the width of the web 1. The full width of the web 1 is engaged with the additional rollers 4, 8 and 9. The slitter includes an additional slit blade 11, and the web 1 is directed to the additional slit blade 11 via the additional roller 9 to be slit into webs having predetermined widths. The web 1 is wound on a roll 12 after being slit.

Therefore, the slitter has no problem even if the widthwise opposite end portions 5 shrink significantly when the web 1 is wound by the oscillation winding method. When the web 1 is supplied from the supply roll 3, the lengths of the widthwise opposite end portions 5 decrease by the shrinkage phenomenon, resulting in a difference in length between the widthwise opposite end portions 5 and the widthwise center portion. But when the web 1 is engaged with the guide roller 2, the widthwise opposite end portions 5 protrude out of the axial opposite end portions of the guide roller 2, so that the difference in length of the web 1 is absorbed. Therefore, the widthwise opposite end portions 5 tense on the guide roller 2 by the tension without looseness, being engaged with the guide roller 2 adequately. As a result, the web 1 does not get wrinkles. The web 1 is slit then so that the widthwise opposite end portions 5 is separated from the web 1. Therefore, when the web 1 is engaged with the additional rollers 4, 8 and 9, the web 1 is engaged adequately not to get wrinkles.

Figure 4:
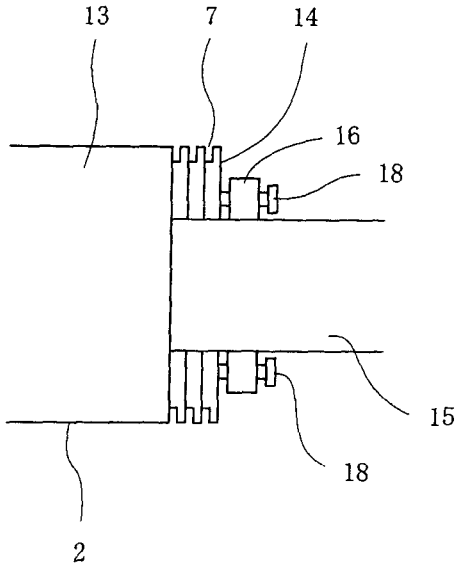
FIG. 4 is a longitudinal-sectional view illustrating a piece in FIG. 3.
Figure 5:
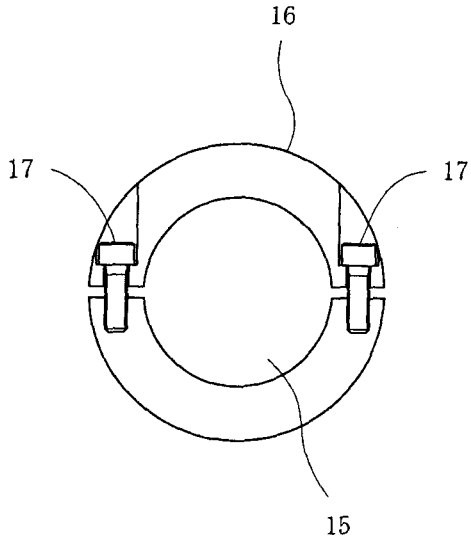
FIG. 5 is a cross-sectional view illustrating a piece in FIG. 4.

In the slitter, the axial center portion of the guide roller 2 is formed by a body 13, while the axial opposite end portions of the guide roller 2 is formed by a plurality of pieces 14. The pieces 14 can be separated from the body 13. For example, the body 13 is fixed on a shaft 15 integrally. The pieces 14 are ring-shaped. And as shown in FIG. 4, the pieces 14 are fit on the shaft 15. The pieces 14 are superposed with each other and pressed against the body 13 axially of the guide roller 2. Split collars 16 are fit on the shaft 15, and as shown in FIG. 5, tightened and fixed by a fixing bolt 17. The pieces 14 are pressed and fixed by a pushing bolt 18 screwed into the split collar 16. The peripheral groove 7 is formed on the each piece 14. The pieces 14 are fit on the shaft 15 on the outer sides of the widthwise opposite end portions of the web 1. The pieces 14 are superposed with each other and pressed against a stopper 19 axially of the guide roller 2.

Therefore, if the split collars 16 are removed from the shaft 15, some pieces 14 on the stopper 19 side can be slid along the shaft 15 and moved toward the body 13. On the other hand, some pieces 14 on the body 13 side can also be slid along the shaft 15 and moved toward the stopper 19. The pieces 14 can be superposed with each other, the split collar 16 can be fixed by the fixing bolt 17, and the pieces 14 can be pressed by the pushing bolt 18 to be fixed. Therefore, the axial length of the guide roller 2 can be adjusted by the pieces 14. The peripheral groove 7 can be formed at the axial opposite end portions. Therefore, even if in the case of various widths of the web 1, the widthwise opposite end portions 5 can be protruded out of the axial opposite end portions of the guide roller 2. The web 1 can be slit by the circular blades 6 at positions of the axial opposite end portions of the guide roller 2.

Figure 6:
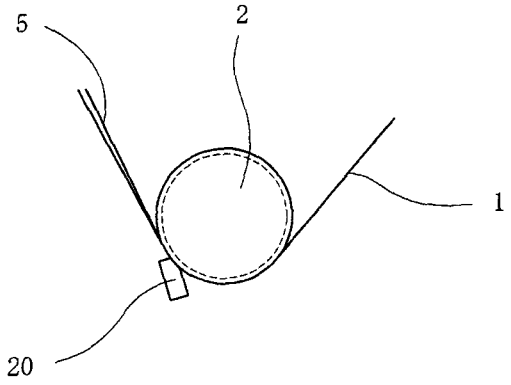
FIG. 6 is an enlarged view illustrating another embodiment of the present invention.

FIG. 6 illustrates another embodiment. In this embodiment, a laser blade 20 is used as the slit blade. The laser blade 20 contacts the web 1 and enters the peripheral groove 7, so that the web 1 is slit by the laser blade 20. Another features is the same as the embodiment in FIG. 1.

Figure 7:
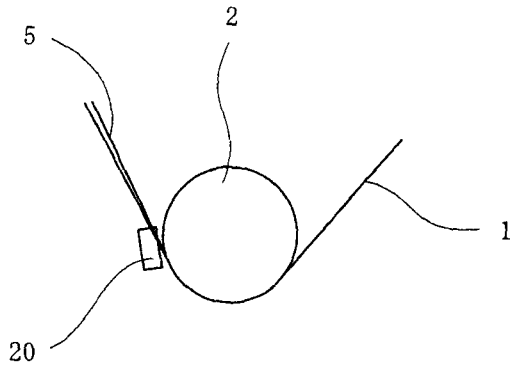
FIG. 7 is an enlarged view illustrating another embodiment of the present invention.

In the embodiment in FIG. 7, when the web 1 is away from the guide roller 2, the web 1 is directed to the laser blade 20 and slit only by the laser blade 20. In the case, it is not required to make the peripheral groove 7 formed at the axial opposite end portions of the guide roller 2. Another features is the same as the embodiment in FIG. 1.

OLFA (registered trademark) blade or another blade can also be used as the slit blade.

DESCRIPTION OF THE REFERENCE CHARACTERS

1 web
2 guide roller
3 supply roll
4 additional roller
5 widthwise opposite end portions
6 circular blade
11 additional slit blade
13 body
14 piece
20 laser blade

The invention claimed is:

1. A slitter-web combination, comprising:

a web wound by an oscillation winding method, the web having a width and widthwise opposite end portions which are shrunk; and a slitter for slitting the web, the slitter including a guide roller having axial opposite end portions and an axial length shorter than the width of the web, an additional roller for guiding the web so as to engage the web with the guide roller, and slit blades for slitting the web at positions of the axial opposite end portions of the guide roller, and a supply roll for supplying and directing the web to the additional roller via the guide roller; and wherein the web is guided by the additional roller so that the widthwise opposite end portions of the web protrude past the axial opposite end portions of the guide roller, and wherein the web is engaged with the additional roller after being slit by the slit blades.

2. The slitter-web combination according to claim 1, wherein the slitter further comprises an additional slit blade for slitting the web into webs having predetermined widths, the web being directed to the additional slit blade via the additional roller.

3. The slitter-web combination according to claim 1, wherein the guide roller includes an axial center portion formed by a body, wherein the axial opposite end portions of the guide roller are formed by a plurality of pieces that are separated from the body to adjust the length of the guide roller, and wherein each of the pieces includes a peripheral groove, the web being sandwiched between the peripheral groove and the slit blade to be slit.

* * * * *